United States Patent [19]

Kumar

[11] Patent Number: 4,750,768

[45] Date of Patent: Jun. 14, 1988

[54] GRIPPER DEVICE

[76] Inventor: V. Sam Kumar, 1300 Clearmont St., Ste. 6, Palm Bay, Fla. 32905

[21] Appl. No.: 863,308

[22] Filed: May 15, 1986

[51] Int. Cl.[4] ..... B66C 1/02

[52] U.S. Cl. ..... 294/64.1; 294/65; 294/907

[58] Field of Search ..... 294/64.1, 65, 907; 414/737, 744 B, 729, 730, 733, 734, 752, 627

[56] References Cited

U.S. PATENT DOCUMENTS

| | | | |
|---|---|---|---|
| 3,865,420 | 2/1975 | Warren | 294/64.1 |
| 4,266,905 | 5/1981 | Birk et al. | 294/64.1 |
| 4,340,234 | 7/1982 | Ise | 294/65 |

*Primary Examiner*—James B. Marbert

*Attorney, Agent, or Firm*—Malin, Haley & McHale; Eugene F. Malin

[57] ABSTRACT

This all pneumatic vacuum gripper which utilizes a fluid amp sensor senses an object when the object comes in contact with vacuum cup. This activates the main venturi vacuum generator which provides the vacuum force necessary to 'grip' the object to be lifted. An external release signal cuts the vacuum 'off' to release the object. Vacuum power is generated only when lifting the object thus saving energy and also minimizing ambient noise. Sensitivity of pick-up level is also adjustable. The preferred embodiment of the all pneumatic vacuum gripper utilizes fluid logic sensing and processing, senses an object when the object comes in contact with the vacuum cup. This activates the main venturi vacuum generator which provides the vacuum force necessary to "grip" the object to be lifted. The fluid logic circuit automatically locks the vacuum in the suction cup while turning "off" the power supplied to the main venturi after a predetermined period of time. Vacuum power is generated only long enough to pick up the object and lock up the vacuum to hold it. An external release signal unlocks the vacuum to release the object.

4 Claims, 2 Drawing Sheets

GRIPPER DEVICE

BACKGROUND OF THE INVENTION

This invention relates to an all pneumatic vacuum gripper that has built-in sensing capabilities.

Traditionally, vacuum grippers consist of a vacuum generator (either an electromechanical vacuum pump or venturi vacuum generator), and a suction cup. To pick-up an object, the vacuum is first turned 'on' and then the vacuum cup is placed on the object's flat surface to grip it which facilitates picking up of the object. To release the object, the vacuum is turned 'off' and the object is separated from the vacuum cup. However, in modern factory automation machines, the size of the objects to be handled may vary from small to very large surface areas and more than one vacuum gripper may be used on the pick up arm. In these cases, all the vacuum grippers will be turned 'on' every time whether the number of suction cups coming in contact with the object being picked up is one or more. Thus the energy expended remains at a constant high level and so is the ambient noise level. Also, the control circuitry always needs to be told when to turn 'on' the vacuum and then to turn it 'off'. Therefore there exists a need for a vacuum gripper that can sense an object under its suction cup and turn itself 'on'.

While an object is being lifted and held under the suction cup, the power utilized to generate the vacuum is continuously expended. In addition, other external means of control circuitry is needed to achieve control over the sequence of operation. Therefore there exists a need for a novel vacuum gripper wherein sensing, actuation and control of the gripper is all achieved in a single device and still only a fraction of the energy is expended to perform the same work.

SUMMARY OF THE INVENTION

This all pneumatic vacuum gripper which utilizes a fluid amp sensor senses an object when the object comes in contact with vacuum cup. This activates the main venturi vacuum generator which provides the vacuum force necessary to 'grip' the object to be lifted. An external release signal cuts the vacuum 'off' to release the object. Vacuum power is generated only when lifting the object thus saving energy and also minimizing ambient noise. Sensitivity of pick-up level is also adjustable.

The preferred embodiment of the all pneumatic vacuum gripper utilizes fluid logic sensing and processing, senses an object when the object comes in contact with the vacuum cup. This activates the main venturi vacuum generator which provides the vacuum force necessary to "grip" the object to be lifted. The fluid logic circuit automatically locks the vacuum in the suction cup while turning "off" the power supplied to the main venturi after a predetermined period of time. Vacuum power is generated only long enough to pick up the object and lock up the vacuum to hold it. An external release signal unlocks the vacuum to release the object.

A general object of this invention is to provide a vacuum gripper arrangement that can 'grip' and pick up an object.

Another object of this invention is to provide a gripper that will sense an object under its suction cup.

Another object of this invention is to turn the vacuum generator 'on' only after the object under the suction cup is sensed.

Another object of this invention is to make this device all pneumatic.

Another object of this invention is to make this device work from a single pneumatic source.

Another object of this invention is to be able to release the object and turn the vacuum 'off' at the command of an external 'release' signal.

Another object of this invention is to lock the vacuum generated in the suction cup.

Another object of this invention is to turn the power to vacuum generator "off" while vacuum is locked in the suction cup.

Another object of this invention is to save energy by actuating vacuum generator for a short period of time.

These and other objects are achieved by the present invention wherein the vacuum gripper has a fluid amp sensor, a fluid amp valve, venturi vacuum generator, a release valve, adjustable restrictors and a vacuum cup. The normally closed fluid amp valve does not allow main air flow to the venturi. A bypass passage allows a significantly small amount of flow through the venturi that generates an extremely low vacuum at low flow. The fluid amp sensor is supplied with a low supply through a restrictor. The sensor line of the fluid amp sensor is connected to the vacuum line between the venturi and the suction cup. When the suction cup is open, the output of the sensor is on 02 leg of the outputs which is vented to atmosphere. When the suction cup comes in contact with an object, the small amount of vacuum generated by the bypass flow is sensed and amplified by the sensor which switches the output from 02 to 01. This signal goes through the release valve, which is normally open, to shift the fluid amp valve into open position. This allows the full main flow to go through the venturi which generates sufficient vacuum to lift the object sensed. When the release signal is applied, it closes the release valve which cuts control signal to fluid amp valve which in turn cuts the vacuum and the object is released. The adjustable bias signal to the fluid amp sensor, allows for sensitivity adjustment of the pick-up.

In the preferred embodiment these and other objects are achieved by the present invention wherein the vacuum gripper has a fluid logic control circuitry, back pressure sensor, a diaphragm isolation device, fluid amp valve, vacuum valve, release valve, venturi vacuum generator, vacuum cup, variable restrictors and a fluid capacitance. In the absence of an object in the vicinity of the suction cup, the vacuum source is turned off and the vacuum cup is isolated from the vacuum source by the normally closed vacuum valve. The back pressure sensor of the fluid logic circuit sends a pneumatic signal through a diaphragm valve into the suction cup. This pneumatic signal leaks through the cup into atmosphere. When the suction cup comes in contact with an object, it blocks the pneumatic flow of the sensor through the suction cup, thus creating a back pressure. This switches the output of the fluid logic circuit which turns on the fluid amp valve that in turn simultaneously turns on the vacuum generator and opens the vacuum valve to connect the suction cup to the vacuum flow. This creates sufficient force to attach the object to suction cup. While this sequence is taking place, the switched output of the sensor/switch sets up a timer that will time out after a set period of time to turn the switch off. With the output of the sensor/switch off, the fluid amp valve and the vacuum valve return to closed position thus turning the vacuum source off and isolating the suction cup from the vacuum source. With the vacuum locked in the suction cup, the object is held in position.

When a reset signal is sent to the release valve, the vacuum is released from the suction cup and the diaphragm device opens the passage from the sensor to the suction cup thus unlocking the vacuum from the suction cup and releasing the object.

In accordance with these and other objects which will be apparent hereinafter, the instant invention will now be described with particular reference to the accompanying drawings.

DESCRIPTION OF THE PREFERRED EMBODIMENT

Figure 1:
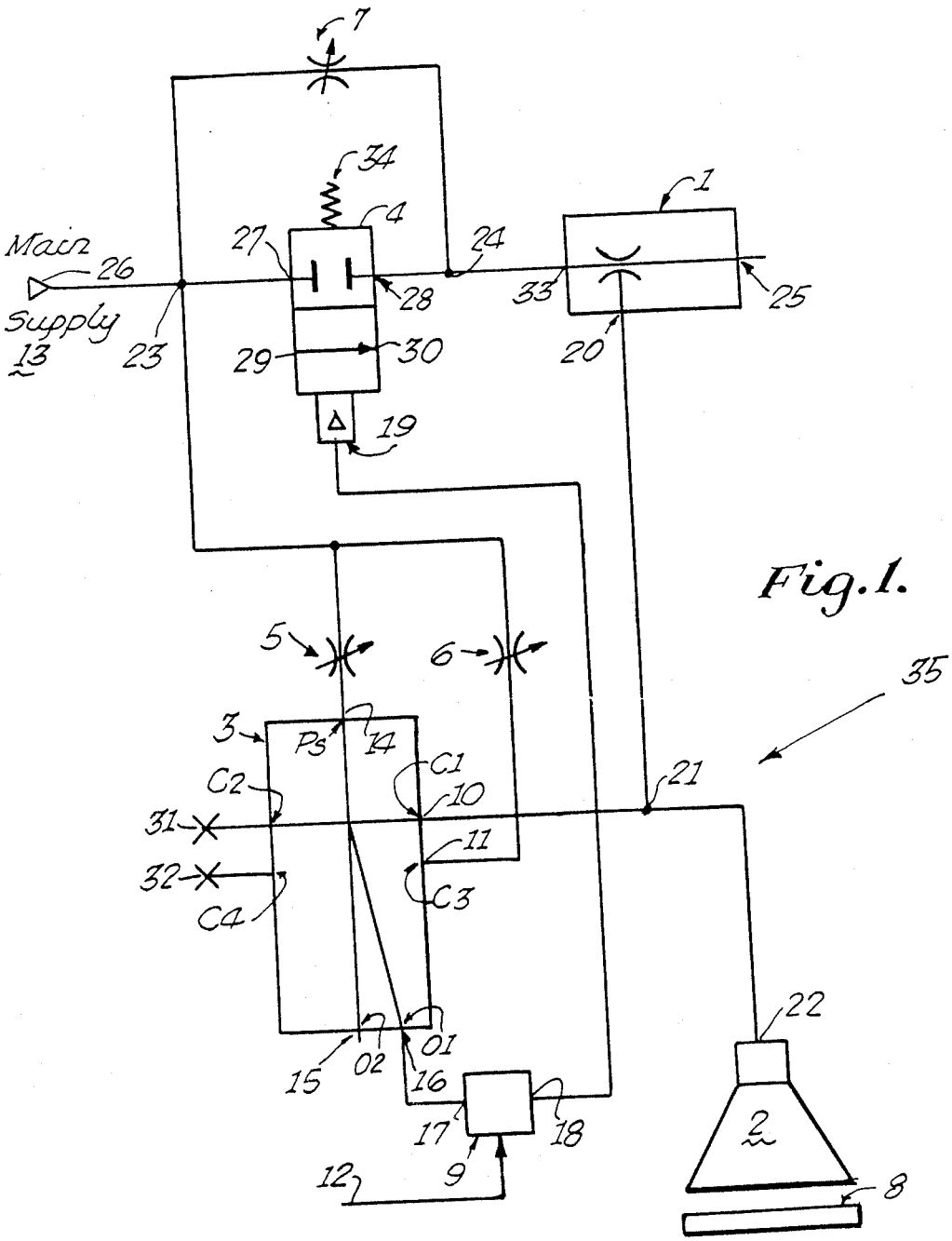
FIG. 1 is a schematic drawing showing the different components of the system and the connections needed to accomplish the objects of this invention.

Referring now to FIG. 1 the pneumatic vacuum gripper includes a sense and grip vacuum gripper 35 includes a venturi 1, a suction cup 2, a fluid amp sensor 3, fluid amp valve 4 and a release valve 9. The main pneumatic supply 13 enters the system at entrance point 26. The fluid amp sensor 3 which happens to be preferably a Schmitt Trigger as manufactured by Corning Fluidics, Corning, NY, has a supply port Ps 14, control port C1 10, control port C2 31, control port C3 11, control port C4 32, output port 01 16, and output port 02 15. The supply port Ps 14 is connected to the main pneumatic supply 13 at junction point 23 via a fixed or preferably a variable restrictor 5 which supplies airflow to the sensor 3 at a lower pressure (between 3 and 15 psi). This sensor 3 is capable of sensing differential or single sided signals and alter the output signal from 02 to 01.

The vacuum port 20 of the venturi 1 is connected to a common junction point 21 which connects to the C1 port 10 of the fluid amp sensor 3 and the connection port 22 of the vacuum cup. The exhaust port 25 is vented to atmosphere.

The junction port 23 of the pneumatic supply is connected to the input port 27 of the fluid amp valve 4. This fluid amp valve 4 is a normally open valve as shown. The output 28 is connected to junction point 24. When a control signal is applied at control port 19, it shifts the valve stem against spring 34 in such a way as to connect port 29 to junction 23 and port 30 to junction 24 and thus establishing a fluid flow through the valve. When control signal is removed from port 19, the spring returns the valve to its original 'off' position.

Another fluid path is established between the junction points 23 and 24 through a preferably variable restrictor 7. This allows for a small amount of fluid flow to go around the fluid amp valve from the main supply to the venturi 1. This small flow or pilot flow through the venturi causes a slight vacuum at the port 20 of the venturi. The energy expended to produce this low level vacuum is significantly less compared to the full flow and power that is expended when the gripper picks up an object.

Yet another fluid path is established between the junction point 23 and control port C3 11 of the fluid amp sensor through a preferably variable restrictor 6. This flow provides for the adjustment of the sensor trigger point.

The output 02 15 of the fluid amp sensor 3 is vented to atmosphere. The output 01 16 of the fluid amp sensor 3 is connected to port 17 of the release valve 9. This release valve 9 may be a simple mechanical toggle valve or a pneumatically operated on/off valve or an electrically operated on/off valve. The output 18 of this valve is connected to the control port 19 of the fluid amp valve. In the absence of the external release signal at 12, the valve 9 will flow freely between the ports 17 and 18. When release signal 12 is applied, it will block off the flow between ports 17 and 18.

Under normal operation, in the absence of any object 8 to be picked up, the main pneumatic supply 13 will supply operating flow to the fluid amp sensor 3 and a pilot flow through the restrictor 7 to the venturi 1. This will produce a very low vacuum flow but the vacuum flow requirement will be easily met due to the full open condition of vacuum cup 2. Under these conditions, the output of fluid amp 3 will be at the output port 02 15. But as soon as an object 8 is brought near the vacuum cup 2, the vacuum flow is choked and the vacuum builds up at junction 21. This lower level pressure is sensed at control port C1 10 of the fluid amp sensor 3. As soon as this level reaches that which is set by control bias signal C3 11, the output switches from 02 15 to 01 16. This signal flows from 16 to port 17 of the release valve 9 to port 18 of the release valve 9 into the port 19 of the fluid amp valve 4. This shifts the valve 4 from closed condition to open condition, thus establishing flow from main supply 13 to venturi inlet port 33 through the junction point 23, input port 29 of fluid amp valve 4 and output port 30 of the fluid amp valve. This establishes the main flow through the venturi 1 to establish the high vacuum level and high flow from suction cup 2. This aids picking up of the object 8 and attaching it to the suction cup 2.

When a release signal 12 is applied to release valve 9, it cuts the control flow from input port 17 to output port 18 thus removing control signal from port 19 of the fluid amp valve 4. This closes the valve 4 and shuts the vacuum from the venturi and hence the suction cup 2 loses vacuum thus releasing the object 8.

Though this invention embodies only an all pneumatic device, it will be obvious to those skilled in the trade to combine other technologies (e.g. electro-pneumatic) to arrive at the same function using the basic philosophy described here. While the invention has been described in conjunction with a specific embodiment, it is to be understood that many alternatives, modifications and variations will be apparent to those skilled in the art in light of the aforegoing description. Accordingly, this invention is intended to embrace all such alternatives, modifications and variations which fall within the spirit and scope of the appended claims.

Figure 2:
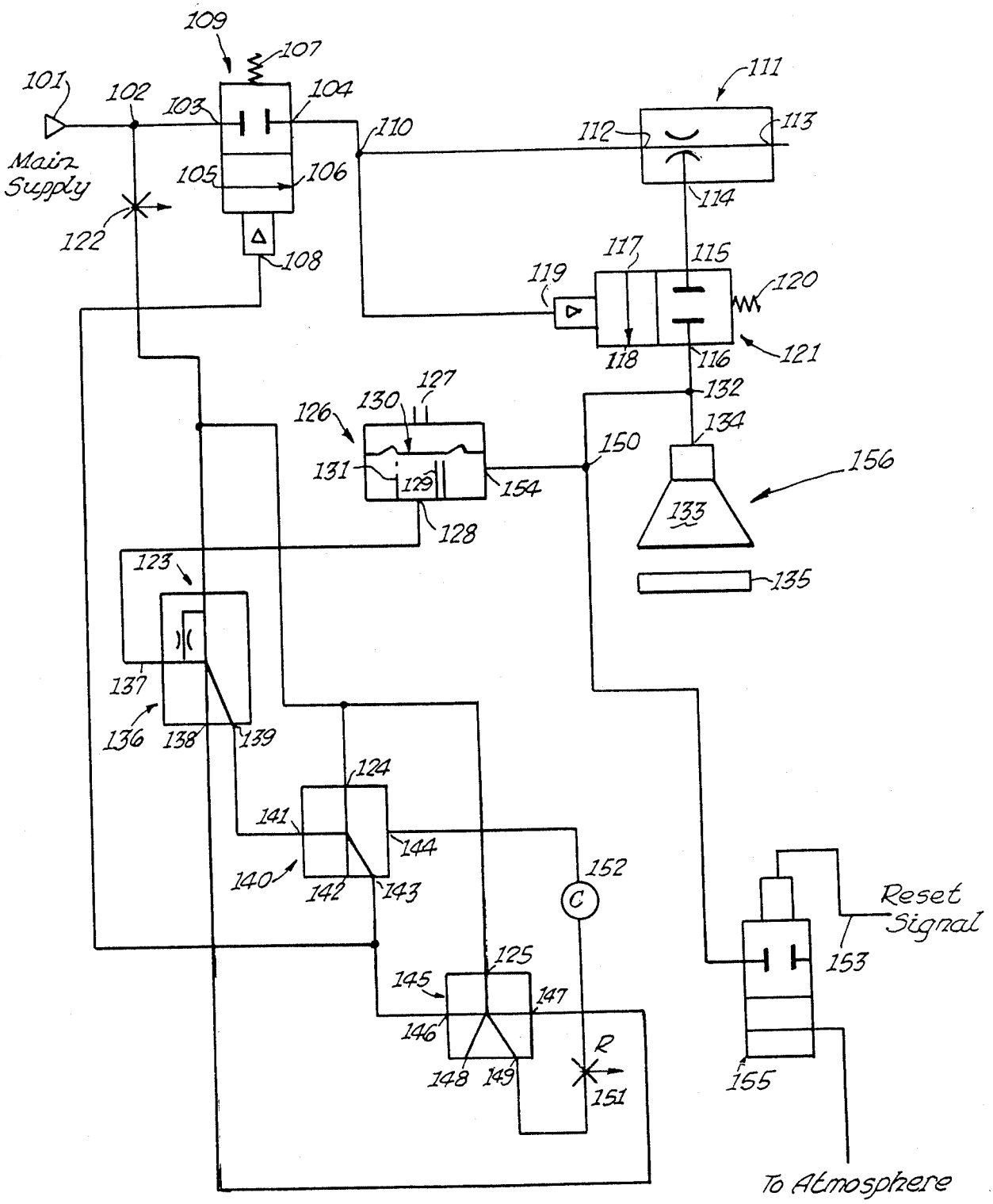
FIG. 2 is a preferred schematic drawing showing the different components of the system and the connections needed to accomplish the objects of this invention.

In FIG. 2, the preferred embodiment of the invention, a sense and lock vacuum gripper 156 includes a venturi 111, a vacuum valve 121, suction cup 133, a fluid amp valve 109, a diaphragm device 126, a back pressure sensor 136, an Inhibited OR/NOR device 140, a bistable device 145, variable restrictor 122, variable restrictor 151, fluid capacitance 152, reset valve 155 and a main supply source 101. The fluid logic devices 136, 140 and 145 are as commercially manufactured by Corning Fluidics, Corning, NY or equivalent. In the absence of any object 135 near the suction cup 133, the system will be in "sense" mode. The fluid amp valve 109 will be in closed position thus shutting off the pneumatic supply 101 to the venturi 111. The vacuum valve 121 will also be in closed position thus isolating the suction cup 133 from the venturi 111. The fluid logic devices' 136, 140 and 145 power supply ports 123, 124, 125 respectively are all connected to the main supply 101 at the junction point 102 through a variable pressure reducing restrictor 122. The diaphragm device 126 has an input port 128, an output port 154 and a vent port 127. The back pressure sensor/switch 136 sends a signal to the diaphragm device which travels from the input port 128 via passage 129 to output port 154. This further travels to junction 132 to port 134 of suction cup 133. Since no object is present near the cup, this signal flows out of the suction cup.

When suction cup 133 rests on the object 135, it blocks the flow which builds up back pressure through the diaphragm device at the back pressure sensor/-switch control port 137. This causes the output of the sensor/switch to switch from output port 138 to output port 139 which is connected to the input port 41 of the Inhibited OR device 140. This control signal causes the output of this device to switch from output 42 to 143. This signal is fed into the control port 108 of the fluid amp valve 109. This shifts the valve against the spring 107 and the open path 105 to 106 takes the place of the closed path 103 to 104. Thus a main flow is established between the main supply 101 and the venturi vacuum generator 111. At the same time the pressure signal from junction point 10 travels to port 119 of the vacuum valve 121 to shift it into open position against the spring 120. The open flow path 117 to 118 takes the position of the closed path 115 to 116. The flow through the venturi in 111 goes from entrance point 112 to exit 113. This creates the vacuum flow at port 114 which is now opened to the suction cup 133 via the now open valve 121.

With the reset valve 155 in closed position and the suction cup 133 on the object 135, vacuum builds up in the channel 154-150-132. This creates a suction force on the diaphragm 130, thus closing it shut and closing the path 129. Thus the suction cup is completely isolated with vacuum and the object 135 is picked up.

The output 49 travels through the restrictor 151 and capacitance 152. This "RC" (Resistor-Capacitance) combination causes a time delay to occur for this signal to travel from point 150 to the inhibited port 44 of the inhibited OR device 140. The duration of the time delay is adjusted by varying the restrictor and the size of the capacitance to allow for enough time for the suction cup 133 to "grip" and hold the object 135. The signal at the inhibit port 144 switches the output of the Inhibited OR device back to 142 from 143.

With the signal turned "off" at 143, the input to the fluid amp valve 109 at port 108 is turned "off". This shifts the valve 109 into closed position which shuts off the vacuum generator 111 and also shifts vacuum valve 121 into closed position.

With the diaphragm device 126 in closed position, valve 121 in closed position, valve 155 in closed position and the object 135 picked up, vacuum in the suction cup is locked and the object 135 is held by the suction cup without the aid of any additional venturi power.

When a reset signal 153 is introduced into valve 155, vacuum is released from the suction cup to atmosphere and thus the object 135 is released and diaphragm 130 springs back up thus opening path 129 again.

Though this invention relates to an all pneumatic concept, it will be obvious to those skilled in the art as to modify this basic philosophy of operation to make it electropneumatic or similar arrangements. While the invention has been described in conjunction with a specific embodiment, it is to be understood that many alternatives, modifications and variations will be apparent to those skilled in the art in light of the aforegoing description. Accordingly, this invention is intended to embrace all such alternatives, modifications and variations which fall within the spirit and scope of the appended claims.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. An all pneumatic vacuum gripper system including a suction gripper means with said pneumatic vacuum gripper system having pneumatic sensing capabilities to provide a sensing state of operations with a first lower fluid flow rate through said suction gripper means and a lifting state of operations with a second higher fluid flow rate through said suction gripper means, comprising:

a pneumatic supply means at said lifting state of operation connected to:

a pneumatic valve means for providing a pneumatic output at said lifting state of operation with said second higher fluid flow rate through said suction gripper means, a restrictor means for providing a pneumatic output at said sensing state of operation with said first lower fluid rate through said suction gripper means, and a pneumatic sensor means positioned in said sensing state to provide said first lower fluid flow rate through said pneumatic valve means in an off position without said output at said lifting state of operation;

said pneumatic valve means connected to said restrictor means connected to said pneumatic sensor means connected to said suction gripper means;

said pneumatic valve means connected to and under the control of said pneumatic sensor means;

said pneumatic supply means connectable to said suction gripper means when said pneumatic valve means is switched to an on position under control of said pneumatic sensor means to switch said pneumatic valve means from said off position to said on position;

whereby said suction gripper means senses by a first lower fluid flow rate an object to be picked up to actuate said pneumatic sensor means to switch on said pneumatic valve means to provide said suction gripping means with said second higher fluid flow rate to pick up an object.

2. A system as set forth in claim 1, including:

a pneumatic vacuum means connected between said pneumatic valve means, said pneumatic sensor means, and said suction gripper means, a release valve means with an input connected between said pneumatic sensor means and said pneumatic valve means for triggering said pneumatic valve means into an off position to have said suction gripping means drop the object.

3. A system as set forth in claim 2, including:

a pneumatic time delay means for actuating said pneumatic sensor system means to place said pneumatic valve means into an off state after a certain lapse in time, said time delay means connected to said pneumatic system means; and means to isolate all components of said pneumatic vacuum gripper system to hold vacuum on said pneumatic gripping means during a third workpiece gripping state of operation.

4. A system as set forth in claim 3, including:

a pneumatic trigger means to release vacuum on said workpiece to drop said workpiece and to restart the cycle of operation.

* * * * *